US005491913A

United States Patent [19]

Hutchinson

[11] Patent Number: 5,491,913

[45] Date of Patent: Feb. 20, 1996

[54] CONTROL SYSTEM FOR THE SUCTION LINE RELIEF VALVE OF A HYDRAULIC DREDGE

[75] Inventor: Timothy A. Hutchinson, Prairieville, La.

[73] Assignee: Pearce Pump Supply, Inc., Prairieville, La.

[21] Appl. No.: 294,560

[22] Filed: Aug. 23, 1994

[51] Int. Cl.[6] ..... E02F 3/16; E02F 3/24

[52] U.S. Cl. ..... 37/311; 37/317; 406/14

[58] Field of Search ..... 37/317, 311, 308, 37/309; 406/10, 12, 14, 30; 417/282, 307, 309; 281/26, 30.01

[56] References Cited

U.S. PATENT DOCUMENTS

| | | | |
|---|---|---|---|
| 2,572,263 | 10/1951 | Hofer | 37/311 |
| 2,603,234 | 7/1952 | Hofer | 37/311 |
| 2,644,400 | 7/1953 | Hofer | 37/311 |
| 2,889,779 | 6/1959 | Hofer | 37/311 |
| 2,938,536 | 5/1960 | Ehrenberg | 37/311 |
| 4,842,244 | 6/1989 | Panchison, Jr. | 251/30.01 |
| 5,172,497 | 12/1992 | Lemonds et al. | 37/59 |

*Primary Examiner*—Randolph A. Reese
*Assistant Examiner*—Spencer Warnick
*Attorney, Agent, or Firm*—Roy, Kiesel & Tucker

[57] ABSTRACT

A control system for the suction line relief valve of a hydraulic dredge is disclosed. The system includes a relief valve actuator which is hydraulically operated; a hydraulic pump powered by a motor; a directional valve; an energy storage device; and hydraulic lines connecting the hydraulic pump, the accumulator, and the relief valve actuator. The accumulator converts the hydraulic pressure in the hydraulic lines into potential energy which is used to generate hydraulic pressure if the pump fails or loses power. The pressure generated is enough for the operator to move the relief valve actuator which will reposition the relief valve to a desired position after pump failure.

7 Claims, 5 Drawing Sheets

CONTROL SYSTEM FOR THE SUCTION LINE RELIEF VALVE OF A HYDRAULIC DREDGE

BACKGROUND OF THE INVENTION

1. Field of the Invention

The present invention relates to control systems for hydraulically actuated relief valves and more particularly to control systems for hydraulically actuated relief valves which are connected to the suction line of a hydraulic dredge.

2. General Background

A hydraulic dredge, of the type used to dredge water bottoms, generally includes a barge, a pump, a suction line and either a boom or a crane. The pump is generally a centrifugal pump having a suction inlet and a discharge outlet. The suction inlet of the centrifugal pump is connected to one end of the suction line. The intake end of the suction line is controlled by the boom or crane, which directs the depth and location of the intake end of the suction line. The pump discharge outlet is connected to a discharge line.

The dredging operation consists generally of positioning the intake end of the suction line near or on the material to be dredged while the pump is operating. The material to be dredged is drawn up the suction line, through the pump, ejected from the discharge outlet of the pump, through the discharge line, and deposited onto the barge.

During dredging, three events may occur which can halt or impair the dredging operation. The first event is blockage of the intake end of the suction line by the dredged material. This intake blockage creates an elevated vacuum level in the suction line. The second event is discharge line blockage caused by dredged material precipitating out from the water and building up in the discharge line. This discharge line blockage creates high pressure at the discharge outlet. Either condition, a high vacuum level or a high pressure level, can cause damage to the pump.

To prevent damage to the pump during absolute blockages and to allow the pump time to work through partial blockages, a relief valve is usually installed in the suction line intermediate the intake end and the centrifugal pump. The relief valve allows water to enter the suction line from a location other than the fully or partially blocked intake end. The relief valve is generally actuated by hydraulic pressure controlled by a control system which monitors the vacuum level in the suction line and the pressure level in the discharge line. When either the vacuum level or the pressure level reaches a predetermined alarm threshold, the control system opens the relief valve allowing water to enter the intake line. The control system closes the relief valve once both the vacuum level and pressure level are below the predetermined alarm threshold.

The third event which may halt or impair dredging operations is failure of the hydraulic power unit due to electrical power interruptions. When the hydraulic power unit fails, hydraulic pressure in the lines connected to the relief valve actuator is no longer sufficient to position the valve. This means the relief valve is stuck in the position in which it happened to be when the hydraulic pump failure occurred. If the relief valve is in the closed position when the hydraulic pump fails, either the vacuum level in the suction line or the pressure level in the discharge line may reach a level which are dangerously high. This condition can significantly increase the risk of damage to the dredge. What is needed is a device, included in the control system, which will allow the operator of the dredge to position the relief valve in a desired position after a hydraulic pump failure has occurred.

SUMMARY OF THE INVENTION

Therefore, it is object of this invention to provide means, in a control system for the suction line relief valve of a hydraulic dredge, for allowing an operator to remotely position the relief valve in a desired position after a hydraulic pump failure has occurred.

It is a further object of the present invention to provide a control system for the suction relief valve of a hydraulic dredge which will automatically open the relief valve after detecting a loss of power to the hydraulic system.

Accordingly, a control system for the suction line relief valve of a hydraulic dredge is described. The control system comprises: a relief valve actuator; a hydraulic pump; a hydraulic pump motor; a directional valve; a first hydraulic line; a second hydraulic line; an energy storage means; a vacuum sensor means; a pressure sensor means; an automatic control means; and, a detecting means. The hydraulic pump has a drive shaft. The hydraulic pump motor has a rotor and an electrical power input. The rotor is mechanically connected to the drive shaft of the hydraulic pump. The directional valve includes means responsive to an electrical signal for selectively directing the flow of hydraulic fluid to one of a plurality of outlet ports. The first hydraulic line is in fluid connection between the hydraulic pump and the directional valve. The second hydraulic line is in fluid connection between the relief valve actuator and the directional valve. The energy storage means is in fluid connection with the first hydraulic line, and mechanically converts hydraulic pressure from the first hydraulic line into stored potential energy which will generate enough hydraulic pressure to move the relief valve actuator to a desired position after electrical power to the hydraulic pump motor has been lost.

DETAILED DESCRIPTION OF PREFERRED EMBODIMENT OF THE INVENTION

Figure 1:
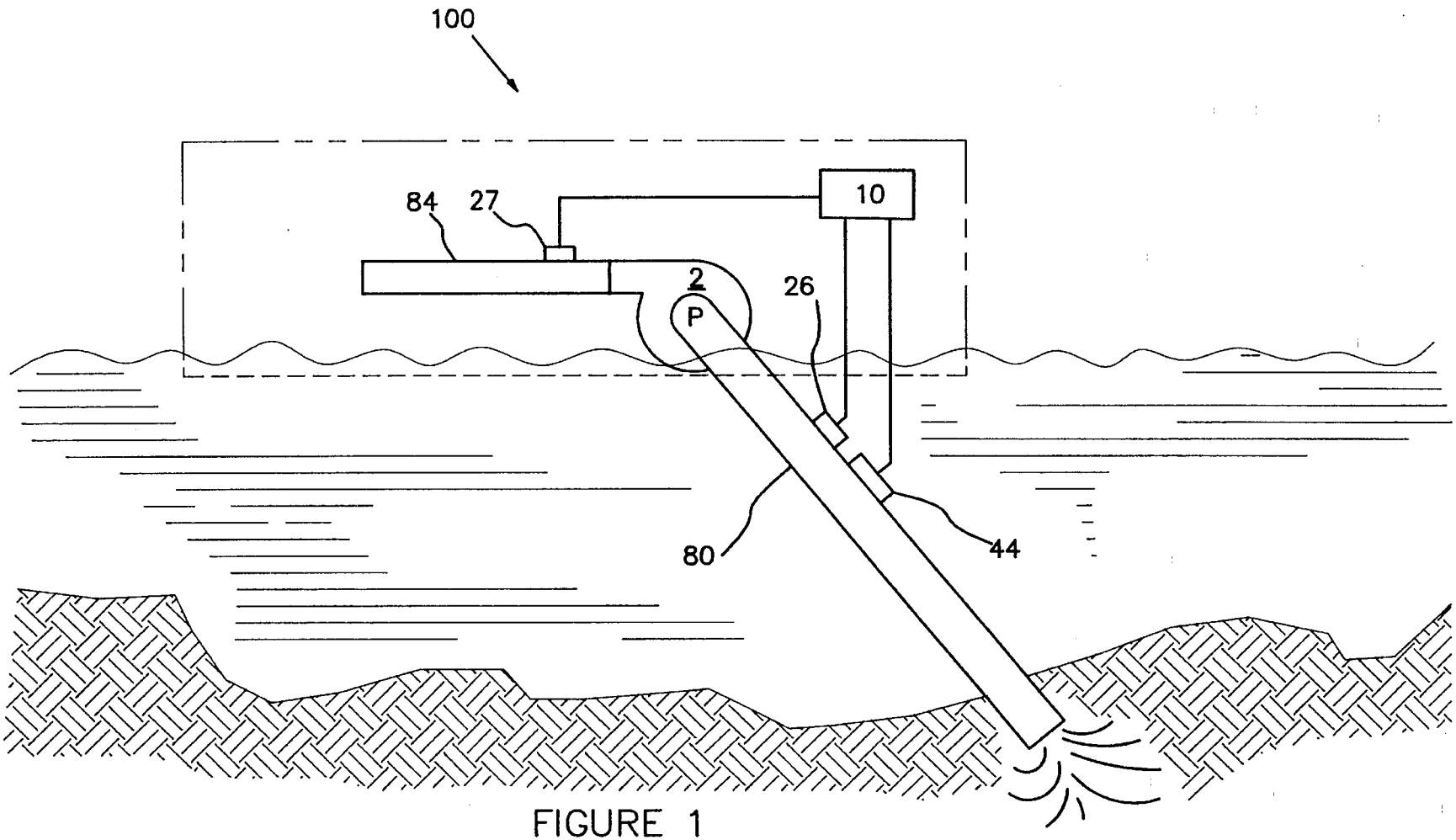
FIG. 1 is a schematic diagram of a typical hydraulic dredge which would include an embodiment of the invention.

FIG. 1 is a schematic diagram of a typical hydraulic dredge 100. Hydraulic dredge 100 will include centrifugal pump 2, suction line 80, and discharge line 84. Vacuum sensor means 26 is mounted on suction line 80 and generates a signal corresponding to the vacuum level in suction line 80. Preferably, vacuum sensor means 26 is a 0–30 inHG vacuum transducer having a 4–20 milliampere output such as a Model 380-C-PP-4-CA-FT vacuum transducer available from GP-50, Inc., Grand Island, N.Y. but any conventional means for sensing and converting a measured vacuum into a signal usable in a control system could be used. Pressure sensor means 27 is mounted on discharge line 84 and generates a signal corresponding to the vacuum level in discharge line 84. Preferably, pressure sensor means 27 is a 0–150 psi pressure transducer having a 4–20 milliampere output such as a Model 380-C- RB-2-CA-FT vacuum transducer available from GP-50, Inc., Grand Island, N.Y., but any conventional means for sensing and converting a measured pressure into a signal usable in a control system could be used. Relief valve 44 is mounted on suction line 80 and is controlled by control system 10.

Figure 2:
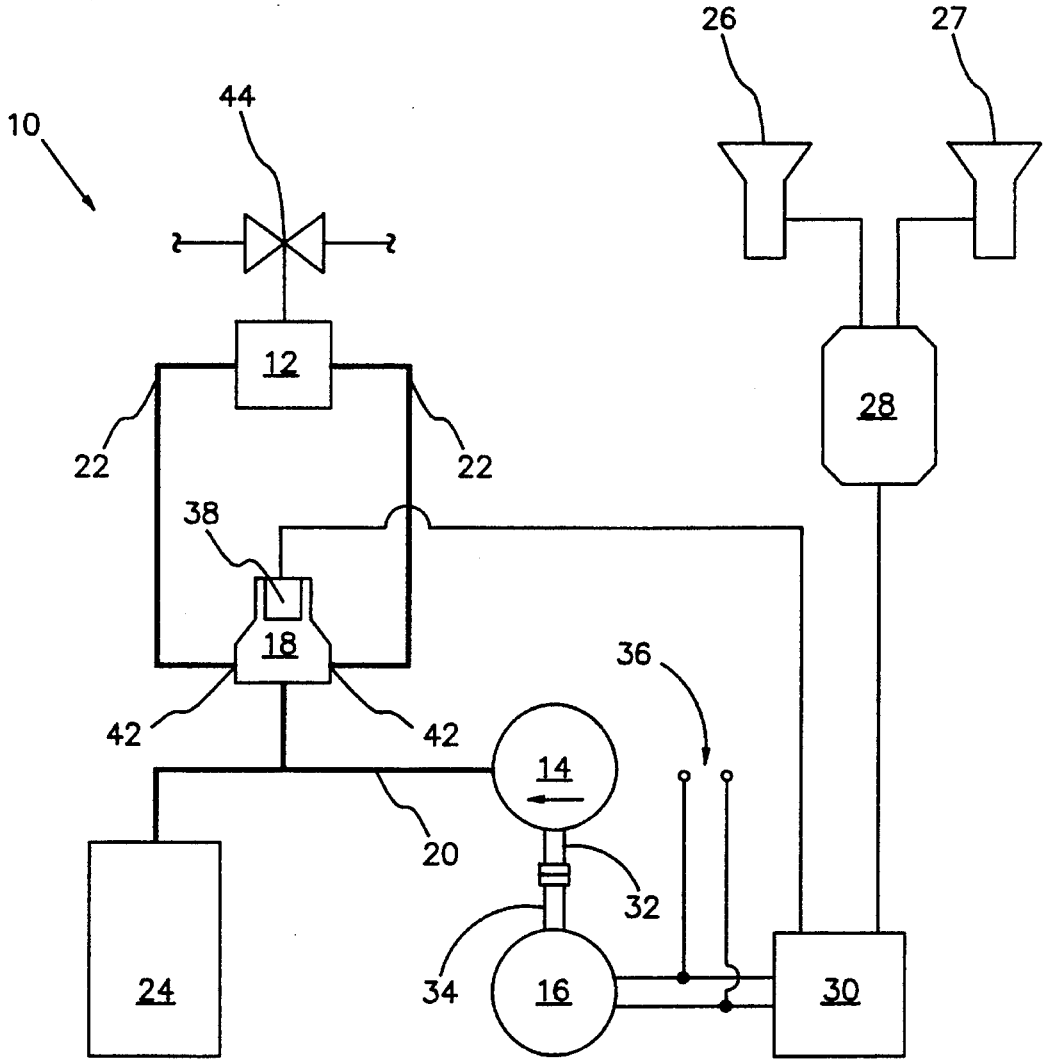
FIG. 2 is a schematic diagram of the control system of the present invention.

FIG. 2 is a schematic diagram of control system 10 for suction line relief valve 44 of hydraulic dredge 100. Control system 10 comprises: relief valve actuator 12; hydraulic pump 14; hydraulic pump motor 16; directional valve 18; first hydraulic line 20; second hydraulic line 22; energy storage means 24; vacuum sensor means 26; pressure sensor means 27, automatic control means 28; and detecting means 30.

As shown in FIG. 2, hydraulic pump 14 has drive shaft 32. Hydraulic pump motor 16 has rotor 34 and electrical power input 36. Rotor 34 is mechanically connected to drive shaft 32 of hydraulic pump 14. Directional valve 18 includes directional valve controller 38, which in response to an electrical signal will move directional valve 18 to selectively direct the flow of hydraulic fluid in first hydraulic line 20 to one of a plurality of outlet ports 42.

First hydraulic line 20 is in fluid connection between hydraulic pump 14 and directional valve 18. Second hydraulic line 22 is in fluid connection between relief valve actuator 12 and directional valve 18.

Energy storage means 24 is in fluid connection with first hydraulic line 20, and mechanically converts hydraulic pressure within first hydraulic line 20 into potential energy which is stored in energy storage means 24. If hydraulic pump motor 16 loses power or hydraulic pump 14 fails for any reason, the potential energy stored in energy storage means 24 will be sufficient to generate enough hydraulic pressure within first and second hydraulic lines 20, 22 to operate relief valve actuator 12. A preferred energy storage means 24 is a Parker Hydraulics model A486231D1K piston-type accumulator.

Automatic control means 28 is in operational connection between vacuum and pressure sensor means 26, 27 and directional valve controller 38. Automatic control means 28 and directional valve controller 38 control the direction of hydraulic fluid flow in response the signals generated by vacuum sensor means 26 and pressure sensor means 27. A preferred automatic control means is a INFP Model 02-00-C2-4803.01, available from Newport Electronics, Inc. of Santa Ana, Calif., but any conventional means of reading input signals and generating a signal based on the input signals could be used.

Detecting means 30 is in electrical connection with the electrical power input 36 of the hydraulic pump motor 16 and directional valve controller 38. Detecting means 30 sends a predetermined electrical signal to directional valve controller 38 when the loss of electrical power to the electrical power input 36 of the electrical motor 16 is detected. Upon receipt of the predetermined electrical signal directional valve controller 38 causes directional valve 18 to direct hydraulic fluid so as to open relief valve 44.

In operation, electrical power is applied to the electrical power input 36 of the hydraulic pump motor 16 causing the rotor 34 to rotate. As rotor 34 rotates, it turns drive shaft 32 of hydraulic pump 14. As drive shaft 32 of the hydraulic pump turns, hydraulic fluid is drawn from a hydraulic fluid reservoir (not shown) and forced under pressure from hydraulic pump 14 into first hydraulic line 20. Pressurized hydraulic fluid then flows from first hydraulic line 20 into energy storage means 24 and directional valve 18.

As pressurized hydraulic fluid enters energy storage means 24, energy storage means 24 stores the energy in the pressurized hydraulic fluid for use in the event of power failure to the electrical motor. As hydraulic fluid enters directional valve 18, the hydraulic fluid is directed to relief valve actuator 12 so that relief valve actuator 12 either opens or closes relief valve 44, with the selection of whether to open or close the relief valve 44 being made by automatic control means 28.

Automatic control means 28 monitors the signals generated by vacuum sensor means 26 and pressure sensor means 27. When the signal from vacuum sensor means 26 indicates that the vacuum level in suction line 80 is above a predetermined setpoint, automatic control means 28 sends a signal, through detecting means 30, to directional valve controller 38, which causes directional valve 18 to direct the hydraulic fluid so as to open relief valve 44. Once the signal from vacuum sensor means 26 indicates that the vacuum level in suction line 80 has fallen below the predetermined setpoint, automatic control means 30 sends a signal to directional valve controller 38 which causes directional valve 18 to direct the flow of hydraulic fluid so as to close relief valve 44. When the signal from pressure sensor means 27 indicates that the pressure level in discharge line 84 is above a predetermined setpoint, automatic control means 28 sends a signal, through detecting means 30, to directional valve controller 38 which causes directional valve 18 to direct the flow of hydraulic fluid so as to open relief valve 44. Once the signal from pressure sensor means 27 indicates that the pressure level in discharge line 84 has fallen below the predetermined setpoint, automatic control means 30 sends a signal to directional valve controller 38 which directs the hydraulic fluid in a manner to close relief valve 44.

If the power supply to hydraulic pump motor 16 is interrupted detecting means 30 interrupts the signal from automatic control means 28. Detecting means 30 then supplies a signal to directional valve controller 38 which causes directional valve 18 to direct the hydraulic fluid so as to open relief valve 44. When power is interrupted the hydraulic pressure required to operate relief valve actuator 12, and in turn relief valve 44, is supplied by energy storage means 24.

Figure 3:
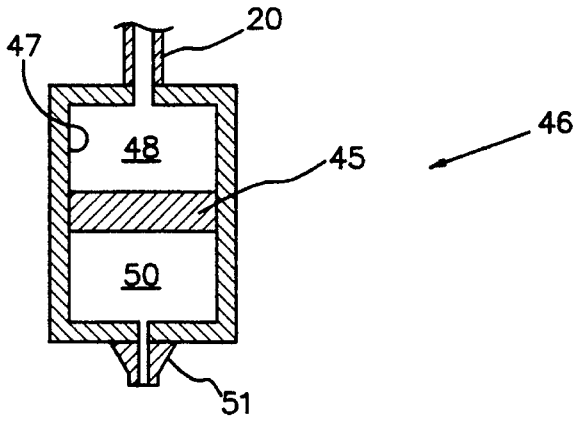
FIG. 3 is a sectional view of a preferred energy storage means.

In a preferred embodiment, energy storage means 24 is accumulator 46, depicted in a sectional view in FIG. 3. Although in the embodiment depicted accumulator 46 is a piston-type accumulator having piston 45 which moves within cylinder 47 creating two variable volume chambers 48, 50, one skilled in the art could practice the invention using other types of accumulators, such as bladder type accumulators or accumulators which store energy in a spring rather than in a compressible gas, or any other type of device for storing energy from a compressed hydraulic fluid.

First chamber 48 of accumulator 46 is in fluid connection with first hydraulic line 20. Second chamber 50 includes a charging port 51 which is sealable. Second chamber 50 is charged with a compressible gas to a desired pressure level and then sealed. In the embodiment depicted nitrogen gas is used to charge second chamber 50 to a pressure of between 200 and 2000 lbs per square inch. The charged pressure level of the second chamber depends on the hydraulic pressure needed to operate relief valve actuator 12 and relief valve 44.

Figure 4:
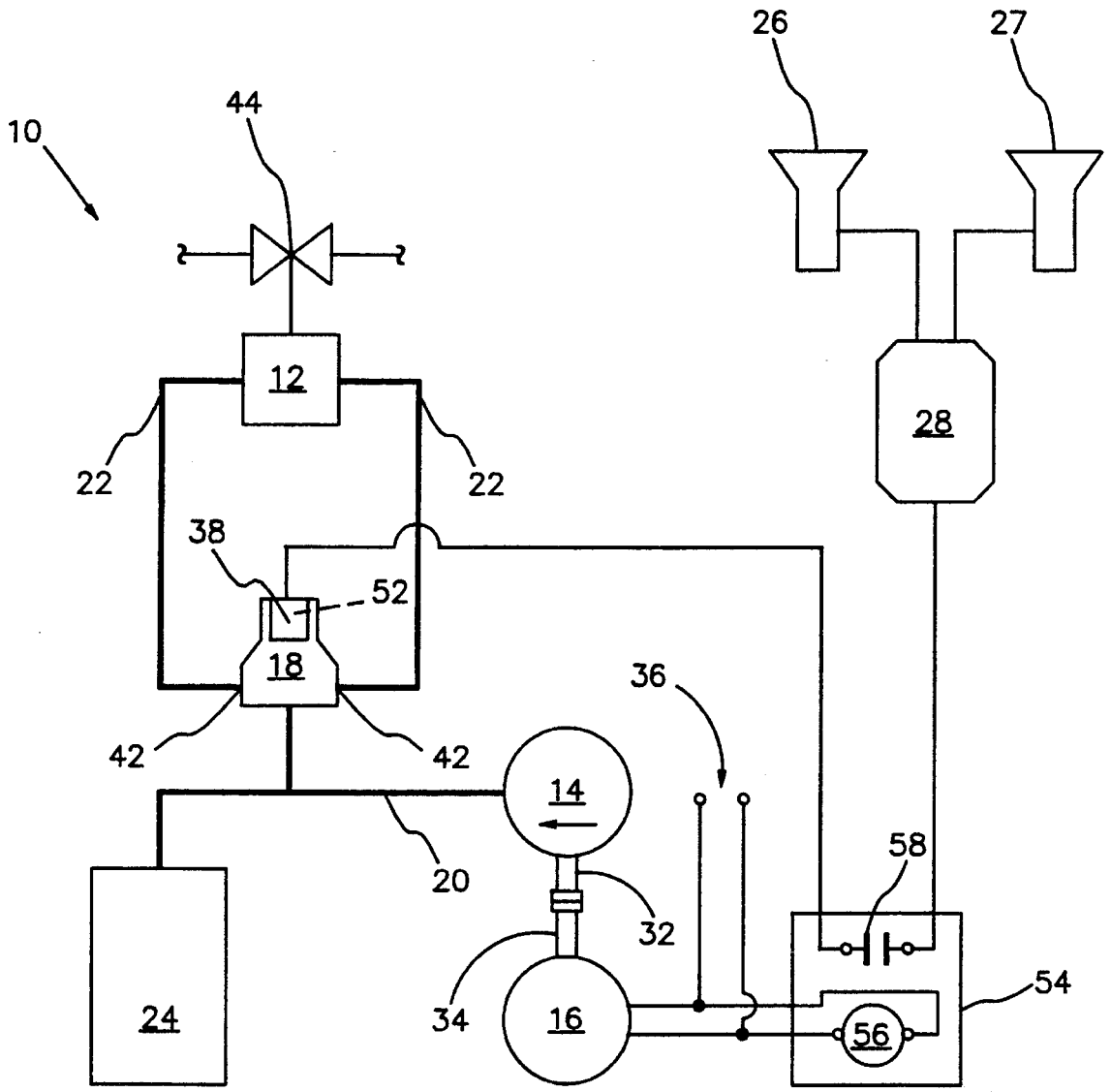
FIG. 4 is a schematic diagram of the control system having a preferred embodiment of a detecting means.

FIG. 4 is an embodiment of control system 10 in which directional valve controller 38 includes a solenoid 52 and detecting means 30 is relay 54. Relay 54 has a relay coil 56 and contacts 58. Relay coil 56 is wired in parallel with electrical power input 36 of hydraulic pump motor 16 and contacts 58 are wired in series between solenoid 52 and automatic control means 28. Relay coil 56 is energized when electrical power is supplied to electrical power input 36 of the hydraulic pump motor 16. Energized relay coil 56 produces a magnetic field which causes contacts 58 to contact one another, thereby completing the electrical path between the automatic control means 28 and the solenoid 52. An interruption of electrical power to electrical power input 36 will also be an interruption in power to relay coil 56. This interruption in electrical power to relay coil 56 will cause contacts 58 to separate and break the electrical path between the automatic control means 28 and solenoid 52.

Solenoid 52 is wired so that as the voltage of the signal sent to solenoid 52 is increased, directional valve 18 directs the flow of hydraulic fluid to relief valve actuator 12 so as to close relief valve 44. When the voltage of the signal to solenoid 52 is decreased or there is zero voltage, directional valve 18 directs the flow of hydraulic fluid to the relief valve actuator 12 so as to open relief valve 44. This "high voltage—relief valve 44 closed, low/no voltage—relief valve 44 open" wiring of solenoid 52 will result in relief valve 44 being automatically opened if there is a loss of power at electrical power input 36.

Figure 5:
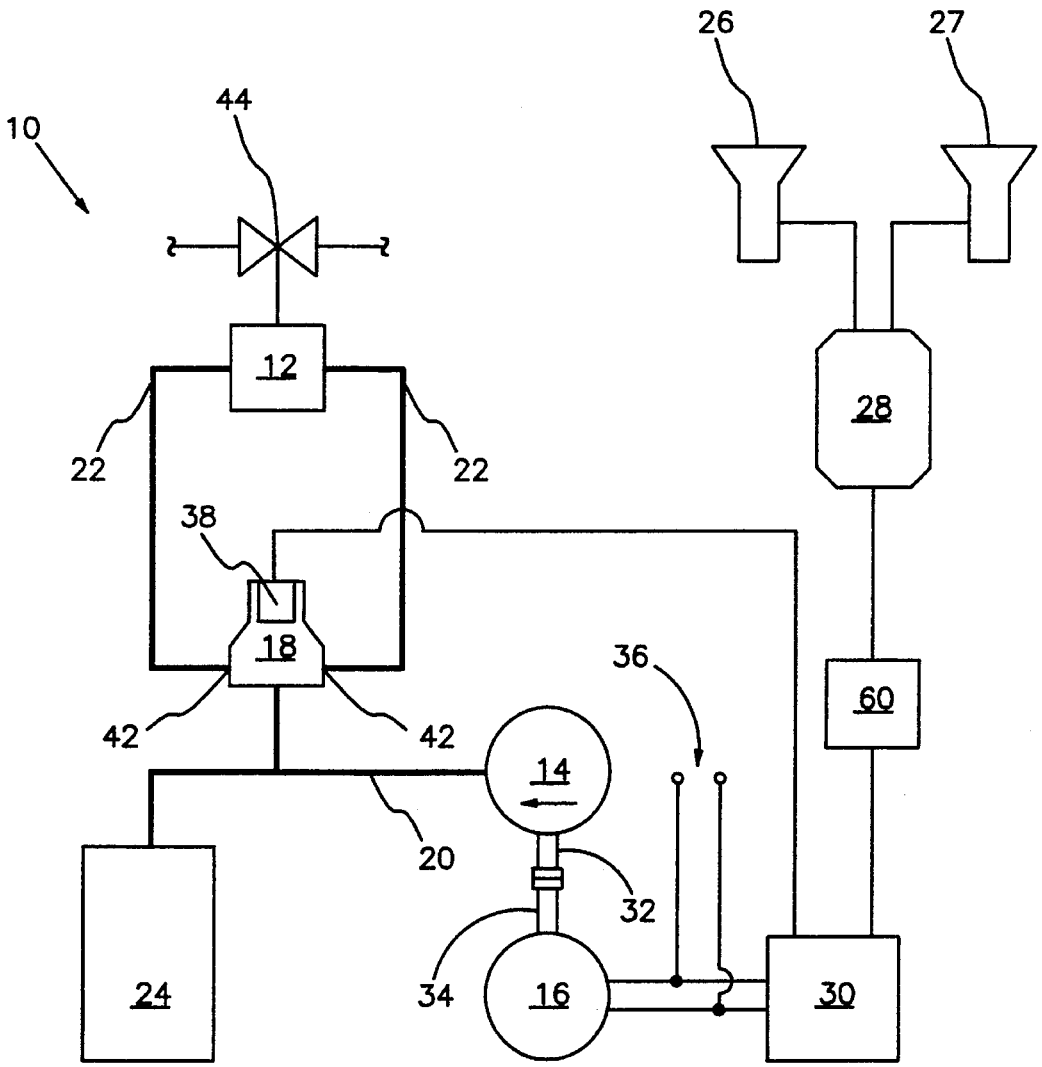
FIG. 5 is a schematic diagram of the control system having a preferred embodiment of an override means controllable by an operator.

Shown in FIG. 5 is another embodiment of control system 10 which includes override means 60 which may be controlled by the operator of the dredge. Override means 60 is in electrical connection between automatic control means 28 and detecting means 30. Override means 60, when activated by the dredge operator, sends an electrical signal via detecting means 30 to directional valve controller 38 to move directional valve 18 so as to close relief valve 44. Override means 60, as the name implies, will cause relief valve 44 to close regardless of the signals being supplied by automatic control means 28.

Figure 6:
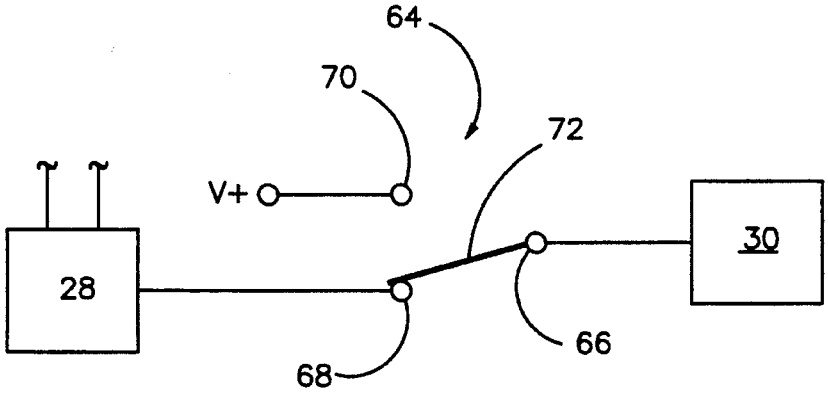
FIG. 6 is a schematic diagram of a preferred override means.

FIG. 6 depicts an embodiment in which override means 60 is two position selector switch 64. Pivoting terminal 66 is electrically connected to detecting means 30, normal operation terminal 68 is electrically connected to automatic control means 28, and override terminal 70 is electrically connected to an electrical power source (not shown) having a voltage level high enough to cause directional valve controller 38 to move relief valve actuator 18 so as to close relief valve 44. As can be seen in FIG. 6, as the pivoting contact 72 pivots from normal operation terminal 68 to override terminal 70, detecting means 30 is electrically disconnected from automatic control means 28 and electrically connected directly to the electrical power source (not shown).

Figure 7:
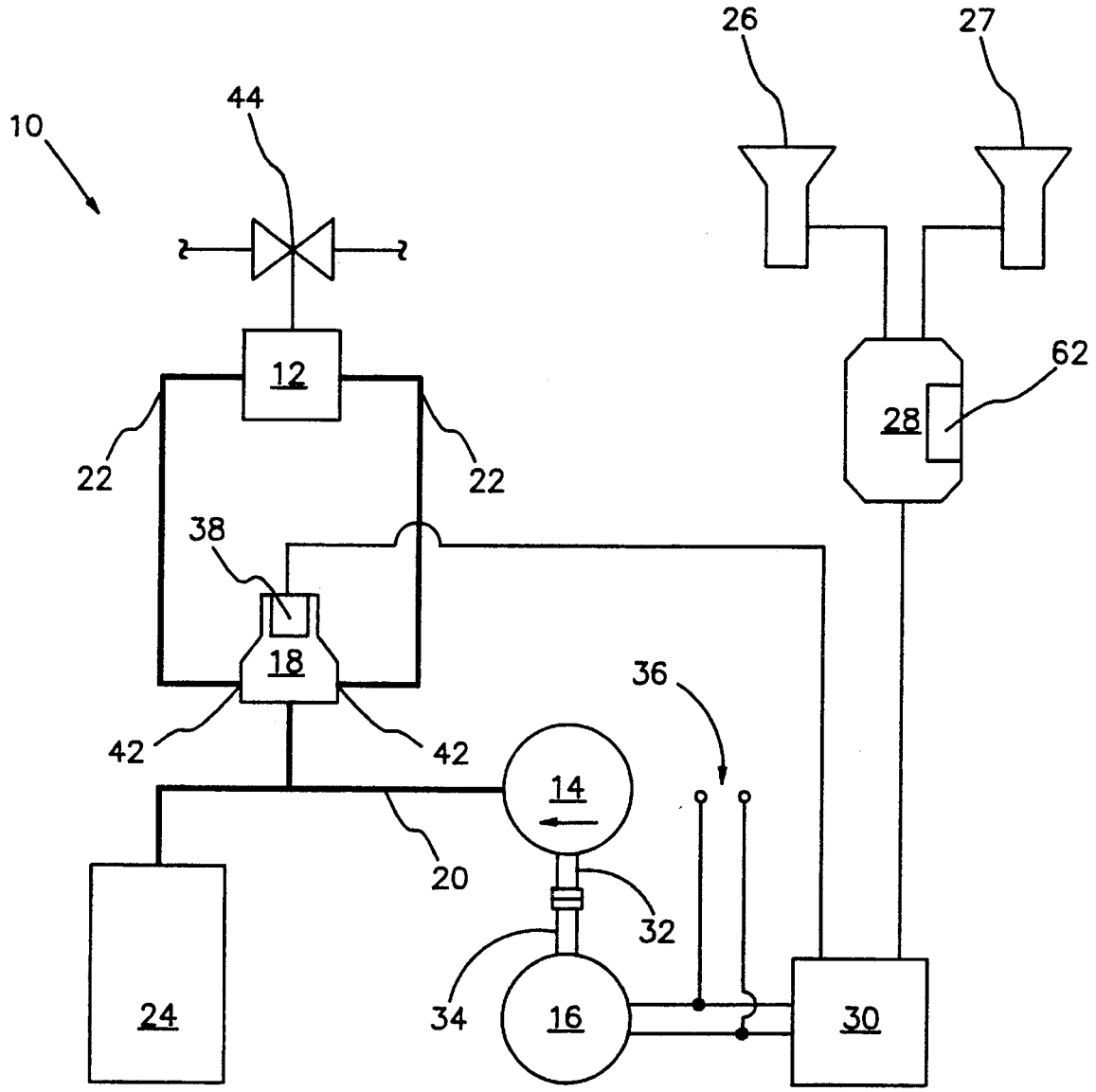
FIG. 7 is a schematic diagram of the control system with a preferred embodiment of an automatic control means which includes setpoint means.

FIG. 7 depicts another embodiment of control system 10 in which automatic control means 28 includes setpoint means 62 for allowing an operator to enter and store operator selectable vacuum level and pressure level setpoints. The automatic control means 28 intermittently compares the setpoints to the signals generated by vacuum sensor means 26 and pressure sensor means 27. When the signal generated by vacuum sensor means 26 indicates a vacuum level greater than the vacuum setpoint or the signal generated by pressure sensor means 27 indicates a pressure level greater than the pressure setpoint, automatic control means 28 sends a signal to directional valve controller which causes directional valve 18 to direct the hydraulic fluid flow so as to open relief valve 44. When the signal generated by the vacuum sensor means 26 indicates a vacuum level less than the vacuum setpoint or the signal generated by pressure sensor means 27 indicates a pressure level less than the pressure setpoint, automatic control means 28 sends a signal to directional valve controller 38 which causes direction valve 18 to direct hydraulic fluid flow so as to close relief valve 44. A Newport Infinity Digital Panel Meter, available from Newport Electronics, Inc. of Santa Ana, Calif., is a suitable automatic control means 28 for use in this preferred embodiment, but any conventional means of reading input signals and comparing those signals with setpoints, then generating a signal based on that comparison could be used.

There are of course other alternate embodiments which are obvious from the foregoing descriptions of the invention which are intended to be included within the scope of the invention as defined by the following claims.

I claim:

1. An apparatus for controlling a suction line relief valve of a hydraulic dredge comprising:

a relief valve actuator for operating a relief valve positioned on the suction line of a hydraulic dredge;

a hydraulic pump having a drive shaft;

a hydraulic pump motor having a rotor and a power input, said rotor being mechanically connected to said drive shaft of said hydraulic pump;

a directional valve, in hydraulic fluid connection with said hydraulic pump and said relief valve actuator, for directing the flow of hydraulic fluid so as to control the movement of said relief valve actuator;

a directional valve controller, mounted on said directional valve, for controlling the operation of said directional valve, said directional valve controller adapted to respond to a signal from a detecting means; said detecting means being in operational connection with said power input of said hydraulic pump motor and said directional valve controller, said detecting means being adapted for sending a predetermined signal to said directional valve controller when said detecting means detects the loss of power to said hydraulic pump motor, said predetermined signal being adapted to cause said directional valve controller to cause the opening of said relief valve; and an energy storage means, in hydraulic fluid connection with said directional valve and said hydraulic pump, for converting hydraulic pressure generated by said hydraulic pump into stored potential energy which will generate hydraulic pressure when said hydraulic pump motor loses electrical power, said hydraulic pressure generated by said energy storage means being sufficient to move said relief valve actuator to a new setting.

2. The apparatus in claim 1, further comprising:

a directional valve controller, mounted on said directional valve, for controlling the operation of said directional valve;

a vacuum sensor means for generating a signal corresponding to the vacuum level in said suction line;

a pressure sensor means for generating a signal corresponding to the pressure level in the discharge line of said hydraulic dredge; and an automatic control means, operationally connecting said vacuum sensor means and said pressure sensor means with said directional valve controller, for reading the signals from said vacuum sensor means and said pressure sensor means and sending a signal to said directional valve controller in response to the signals from said vacuum sensor means and said pressure sensor means; and setpoint means, operationally connected to said automatic control means, for allowing an operator to enter and store vacuum and pressure level setpoints, wherein said automatic control means compares said setpoints to the signals generated by said vacuum sensor means and said pressure sensor means so that when the signals generated by said vacuum sensor means and said pressure sensor means indicate a vacuum level greater than, or a pressure level greater than, said setpoints, said automatic control means sends a signal to said directional valve controller so as to open said relief valve, and when the signals generated by said vacuum sensor means and said pressure sensor means indicate a vacuum level less than, or a pressure level less than, said setpoints, said automatic control means sends a signal to said directional valve controller so as to close said relief valve.

3. The apparatus in claim 1, further comprising:

a vacuum sensor means for generating a signal corresponding to the vacuum level in said suction line;

a pressure sensor means for generating a signal corresponding to the pressure level in the discharge line of said hydraulic dredge; and an automatic control means, operationally connecting said vacuum sensor means and said pressure sensor means with said directional valve controller, for reading the signals from said vacuum sensor means and said pressure sensor means and sending a signal to said directional valve controller in response to the signals from said vacuum sensor means and said pressure sensor means; and setpoint means, including in said automatic control means, for allowing an operator to enter and store vacuum and pressure level setpoints, and wherein said automatic control means intermittently compares said setpoints to the signals generated by said vacuum sensor means and said pressure sensor means so that when the signals generated by said vacuum sensor means and said pressure sensor means indicate a vacuum level greater, or a pressure level greater, than said setpoints, said automatic control means sends a signal to said directional valve controller so as to open said relief valve, and when the signals generated by said vacuum sensor means and said pressure sensor means indicate a vacuum level less than, or a pressure level less than, said setpoints, said automatic control means sends a signal to said directional valve controller so as to close said relief valve.

4. The apparatus of claim 3, further comprising override means, controllable by an operator, and in operational connection with said directional valve controller, for sending a signal to said directional valve controller so as to close said relief valve.

5. The apparatus of claim 4, wherein said energy storage means comprises a piston-type accumulator having first and second chambers, wherein said first chamber is in hydraulic fluid connection with said hydraulic pump and said directional control valve and said second chamber is sealed and charged with a compressible gas.

6. The apparatus of claim 5 wherein said directional valve controller further comprises a solenoid, said solenoid electrically configured so as to cause said directional valve to direct the flow of hydraulic fluid so as to open said relief valve when no electrical power is supplied to said solenoid; and said detecting means further comprises a relay having a relay coil operationally connected to a set of electrical contacts, said relay coil being wired in parallel with said power input of said hydraulic pump motor, said electrical contacts being wired in series between said automatic control means and said solenoid, said relay being adapted so that when electrical power is supplied to said power input, said relay coil is energized and urges said electrical contacts to close and when electrical power is not supplied to said power input, said coil is deactivated and said electrical contacts are opened.

7. An apparatus for controlling a suction line relief valve of a hydraulic dredge comprising:

a relief valve actuator for operating a relief valve positioned on the suction line of a hydraulic dredge;

a hydraulic pump having a drive shaft;

a hydraulic pump motor having a rotor and an electrical power input, said rotor being mechanically connected to said drive shaft of said hydraulic pump;

a directional valve, in hydraulic fluid connection with said hydraulic pump and said relief valve actuator, for directing the flow of hydraulic fluid so as to control the movement of said relief valve actuator;

a directional valve controller, mounted on said directional valve, for controlling the operation of said directional valve;

a vacuum sensor means for generating a signal corresponding to the vacuum level in said suction line;

a pressure sensor means for generating a signal corresponding to the pressure level in the discharge line of said hydraulic dredge;

an automatic control means, operationally connecting said vacuum sensor means and said pressure sensor means with said directional valve controller, for reading the signals from said vacuum sensor means and said pressure sensor means and sending a signal to said directional valve controller in response to the signals from said vacuum sensor means and said pressure sensor means; and setpoint means, included in said automatic control means, for allowing an operator to enter and store vacuum and pressure level setpoints, wherein said automatic control means intermittently compares said setpoints to the signals generated by said vacuum sensor means and said pressure sensor means so that when the signals generated by said vacuum sensor means and said pressure sensor means indicate a vacuum level greater than, or a pressure level greater than, said setpoints, said automatic control means sends a signal to said directional valve controller so as to open said relief valve, and when the signals generated by said vacuum sensor means and said pressure sensor means indicate a vacuum level less than, or a pressure level less than, said setpoints, said automatic control means sends a signal to said directional valve controller so as to close said relief valve.

* * * * *